US008112901B2

(12) United States Patent
Cao et al.

(10) Patent No.: US 8,112,901 B2
(45) Date of Patent: Feb. 14, 2012

(54) SEAL UNIT OF GAS DRYER

(75) Inventors: Chunhua Cao, Qingdao (CN); Peishi Lv, Qingdao (CN); Tao Zhang, Qingdao (CN); Jiantao Sun, Qingdao (CN); Kun Yang, Qingdao (CN); Yiping Bian, Qingdao (CN)

(73) Assignees: Haier Indesit(Qingdao) Washing Machine Co., Ltd., Qingdao, Shandong (CN); Haier Group Company, Qingdao, Shandong (CN)

( * ) Notice: Subject to any disclaimer, the term of this patent is extended or adjusted under 35 U.S.C. 154(b) by 627 days.

(21) Appl. No.: 12/132,876

(22) Filed: Jun. 4, 2008

(65) Prior Publication Data

US 2009/0000145 A1 Jan. 1, 2009

(30) Foreign Application Priority Data

Jun. 28, 2007 (CN) ..... 2007 1 0123076

(51) Int. Cl.
*F26B 25/08* (2006.01)

(52) U.S. Cl. ..... 34/242

(58) Field of Classification Search ..... 34/242, 34/417

See application file for complete search history.

(56) References Cited

U.S. PATENT DOCUMENTS

| | | | | |
|---|---|---|---|---|
| 2,830,384 | A * | 4/1958 | Zehrbach | 34/604 |
| 2,875,996 | A * | 3/1959 | Hullar | 34/82 |
| 3,020,185 | A * | 2/1962 | Moffitt, Jr. et al. | 428/365 |
| 6,024,496 | A * | 2/2000 | Shy | 384/279 |
| 6,945,251 | B2 * | 9/2005 | Woodburn, III | 128/857 |

FOREIGN PATENT DOCUMENTS

DE 3333345 A * 3/1985

* cited by examiner

*Primary Examiner* — Jiping Lu

(74) *Attorney, Agent, or Firm* — Buchanan Ingersoll & Rooney PC

(57) ABSTRACT

A seal unit is adapted to a gas dryer. The seal unit is assembled on the chamber rear wall, an end of heating disk is compressing on the seal unit. Said seal unit includes seal loop shaped as a ring, this seal loop is composed of inner fix part with the shape of flat-sheet ring and outer seal part shaped as a closed ring. The seal unit can, bring effective sealing performance, decrease the leakage of hot-air, quicken drying speed and have high efficiency. Additionally, the seal unit can, be easily produced, have high reliability and have better consistency of production quality.

7 Claims, 7 Drawing Sheets

SEAL UNIT OF GAS DRYER

FIELD OF THE INVENTION

This invention is involving gas dryer, especially the seal unit of gas dryer.

BACKGROUND OF THE INVENTION

Gas dryer is a kind of drying device using natural gas to heat and in which the clothes are drived to roll by motor. This drying device is very popular in the USA because of its low cost and fast drying speed.

Power consumption of the electric quantity of drying unit load is an important technical index. The lower the value is, the less the power consumption of the machine would produce, it means to save more energy.

On the premise of guarantee the production process, optimizing the air sealing of the hot-air duct would save more energy and cost less in one hand, as well as raise the drying speed and efficiency and improve the harmoniousness of washer and dryer in the other hand (at present drying time-consumption is shorter in washer than in dryer, and performance degradation of dryer would further perplex the customers). As above, the sealing of hot-air duct is the key point of gas dryer. Worse sealing performance would lead more energy consumption; and unstable air flow would affect the stability of burner of gas dryer and slow the drying speed. Furthermore, the most important part of sealing structure is the seal between rotatable chamber and still air duct (heating disk or rear board).

There is a present sealing system between chamber and heating disk shown in FIG. 1. The chamber 10 of the present dryer shown in FIG. 1 is integrated part, heating disk 11 and hot-air duct 13 are assembled on the case. The structure of the sealing system is as follow: felt 12 is set perpendicularly on one end of heating disk 11. Felt 12 is also fixed on the chamber rear wall for sealing.

The above-mentioned dryer is of better production process and low cost, but the consistency of the production, the sealing performance and the durability would be worse. The sealing system is the felt perpendicular to the end of heating disk to seal the rotatable chamber with heating disk. Because of the rotating of the chamber, sloshing would easily appear on both end of chamber. Thus the gap between the chamber and heating disk would change ceaselessly. To settle this problem, the producer employ elastic felt to compensate the widen and narrowed gap caused by the sloshing. The above elastic felt has 5 mm thick and 20-30 mm height. But this elastic felt is of finite elastic and hardly compensating all the gaps, thus directly affect the sealing performance and have less service life than 10 years. And it would also lead low efficiency and slow drying speed, as well as high energy consumption and cost.

SUMMARY OF THE INVENTION

The present invention is focus on the objections of the present arts, to provide a seal unit of gas dryer of effective sealing performance, long service life and easily processing and assembling.

The technical scheme to realize the invention is as follow:

A seal unit of gas dryer is assembled on the chamber rear wall. The end of heating disk is compressing said seal unit which comprises seal loop shaped as a ring, said seal loop is composed of inner fix part with the shape of flat-sheet ring which is fixed on the chamber rear wall, and outer seal part for sealing chamber rear wall with heating disk, said outer seal part joints with one end of the flat-sheet ring of the inner fix part, heating disk is compressing on the outer seal part which has a ring section.

Said outer seal part has a shape of closed ring and its section is also a closed ring formed by the crimp of one end of the flat-sheet ring of inner fix part to the other end. Flexible porous material is filled in the section of said outer seal part on which surface salients are mounted. The ratio of the diameter of the section ring of the outer seal part to the difference value between the inner and outer radius of said flat-sheet ring is 0.5-1.2.

Said outer seal part has a shape of closed ring and its section is an open ring formed by the crimp of one end of the flat-sheet ring of inner fix part to the other end, a cirque made of elastic material which has the same shape of the section of said open ring is filled in this open ring, an amount of salients are set on the surface of the outer seal part.

Said seal loop is fixed on the chamber rear wall by thermosol. The seal unit further comprises a fixed loop assembled between the chamber rear wall and heating disk, this fixed loop is composed of fastening teeth for fixing seal loop and fixed structure for assembling the fixed loop on the chamber rear wall.

The fastening teeth are set on the outer end of the circumference of the fixed loop and said fixed structure is formed by fixed holes set on the fixed loop, and corresponding fixed blocks with at least one threaded hole are respectively set on the chamber rear wall. Said fixed loop is fixed on the chamber wall with screws through fixed holes and blocks with threaded holes, and inner fix part is fixed on the chamber rear wall by fastening teeth.

Said seal loop is made of wool felt.

The advantages of the invention are as follow:

1. The outer seal part of the seal unit concerned in the invention has closed structure with a ring section. When the chamber rotates, sloshing would easily appear at both the front and back end of the chamber. And when the gap between the chamber rear wall and heating disk is narrowed, the end of the chamber would tightly compress on the outer seal part, the sealing performance is effective; when the gap between the chamber rear wall and heating disk is widen, the outer seal part would effectively make up the widen gap because of its good elasticity to guarantee the effective sealing performance between the chamber rear wall and heating disk.
2. The flexible porous or elastic materials filled in the ring section of the outer seal part would enhance the elasticity of the seal unit, and the salients on the outer surface of the outer seal part would also enhance the friction between the seal loop and heating disk to bring better sealing performance. Because of the said more effective sealing performance, the leakage of the hot-air would be decreased, the drying speed could increase by 5-10% meanwhile.
3. It is convenient to use fastening teeth to fix the felt on the chamber without any staple.
4. The felt with long service life of 10 years would play effective sealing performance.
5. The sealing unit concerned in this invention is also easily assembled without any worry about the dislocation or inclination of the felt.

To further introduce the structure and performance of this invention, it would provide several preferred embodiments in accordance with the drawings below.

Figure 1:
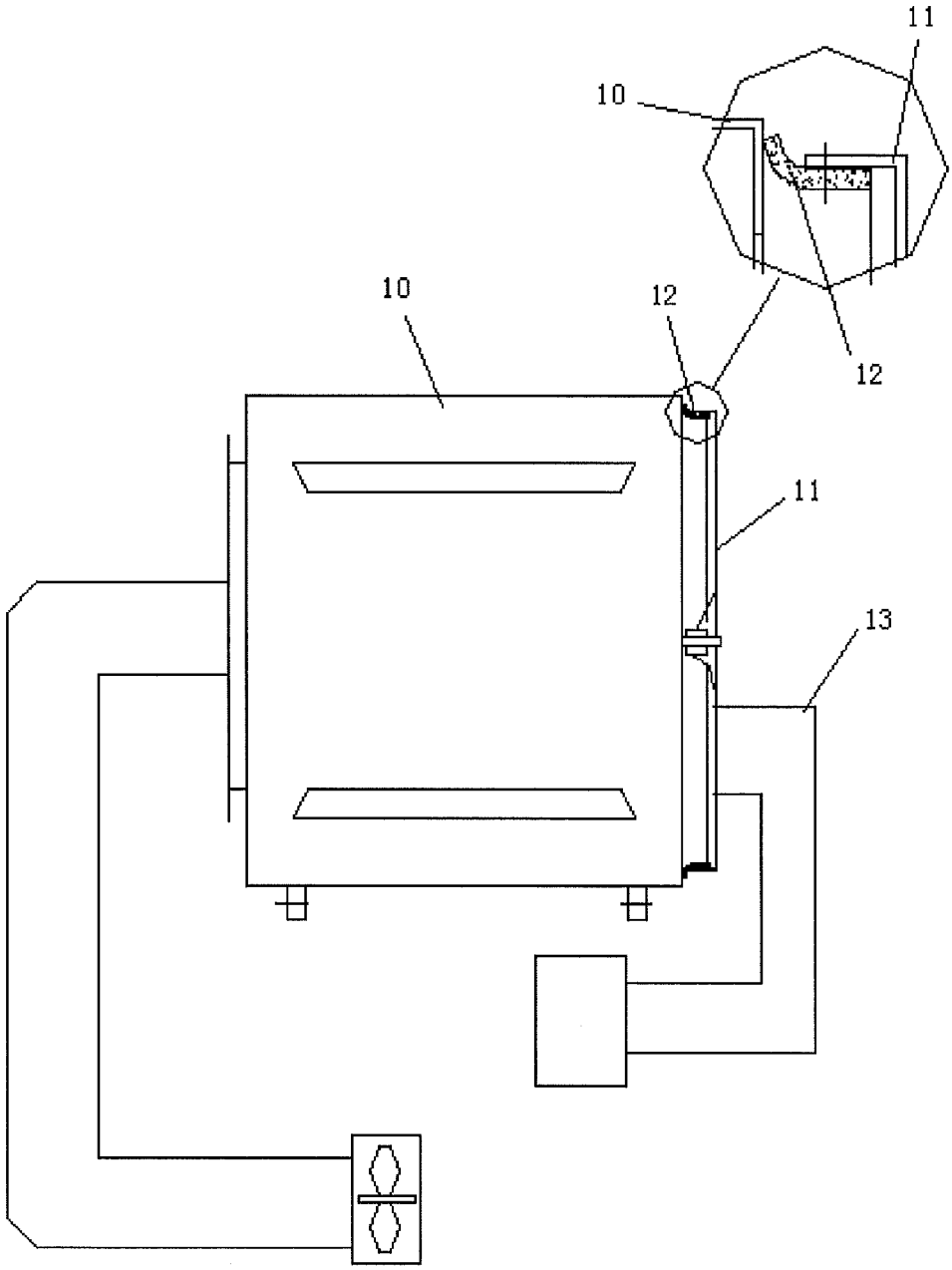
PRIOR ART Fig. 1
FIG. 1 is a schematic view of the structure of a present sealing system.

The names of the devices marked in the drawings

| | | | | | |
|---|---|---|---|---|---|
| 20 | chamber | 21 | chamber body | 22 | chamber rear wall |
| 23 | hot-air hole | 24 | supporting shaft | 25 | threaded hole |
| 26 | fixed block | 30 | heating disk | 40 | hot-air duct |
| 50 | seal loop | 51 | outer seal part | 52 | inner fix part |
| 60 | fixed loop | 61 | fixed hole | 70 | filling cirque |
| 80 | salient | 81 | fastening teeth | | |

THE PREFERRED EMBODIMENTS OF THE INVENTION

Figure 2:
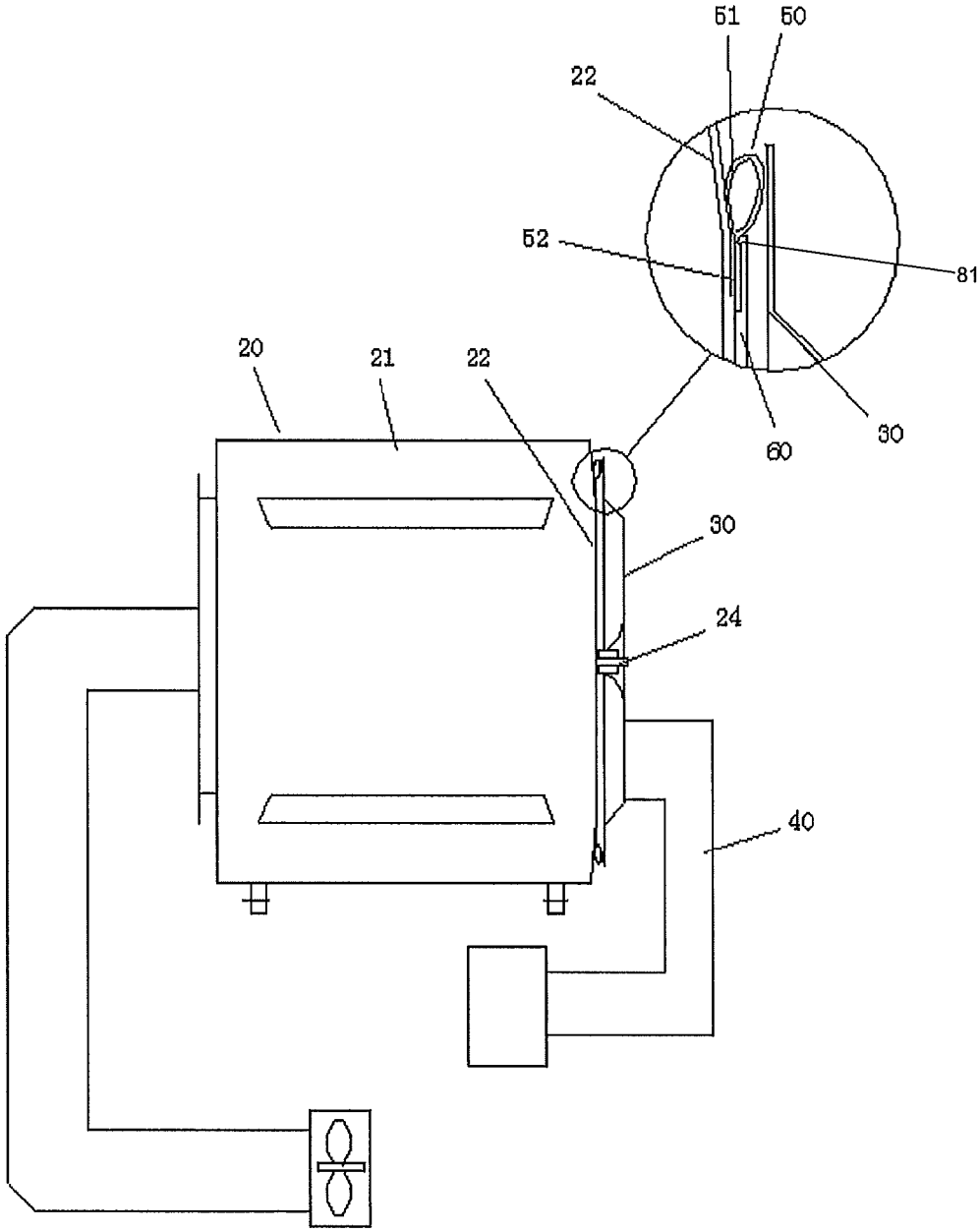
FIG. 2 is a schematic view of the structure of the seal unit of gas dryer of the invention.
Figure 3:
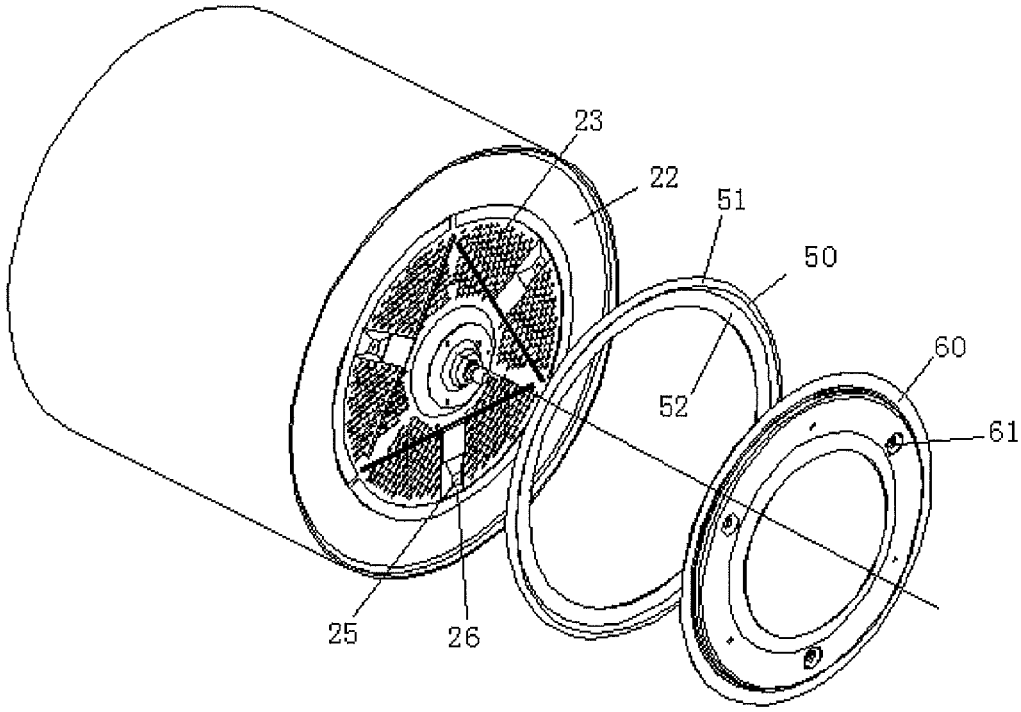
FIG. 3 is the decomposition schematic view of the fixed structure of seal loop of gas dryer.
Figure 4:
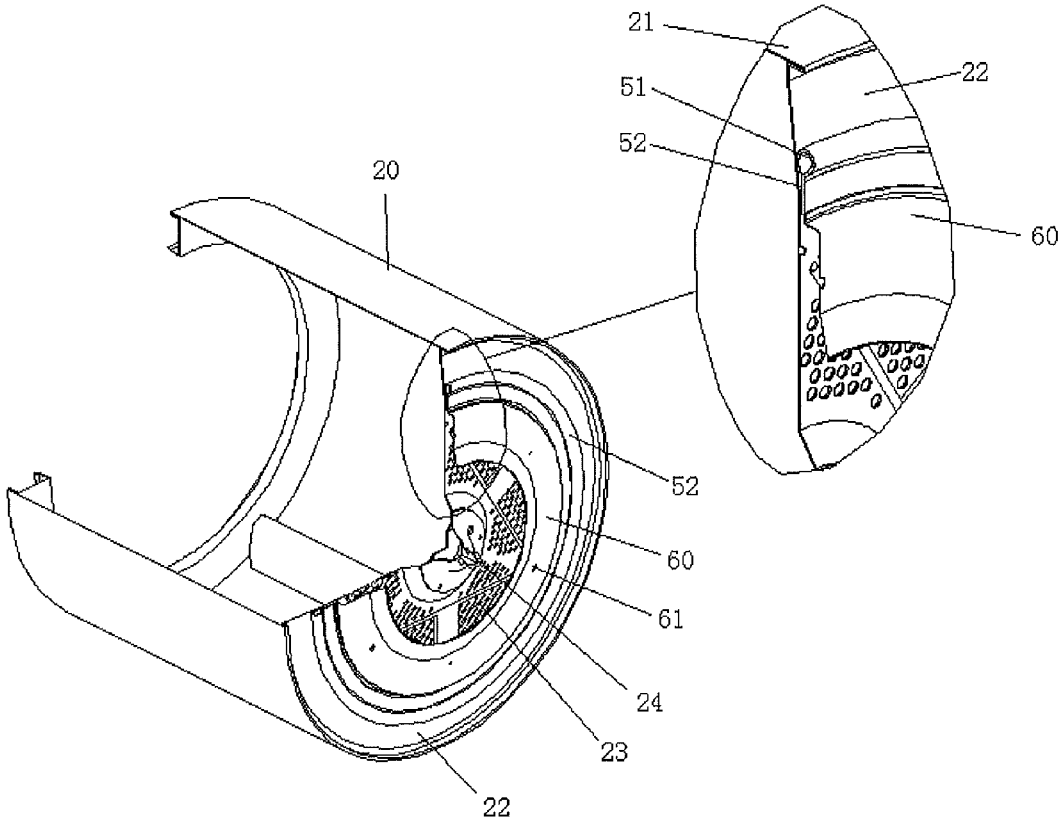
FIG. 4 is the disassembly elevational view of the fixed structure of seal loop of gas dryer.
Figure 5:
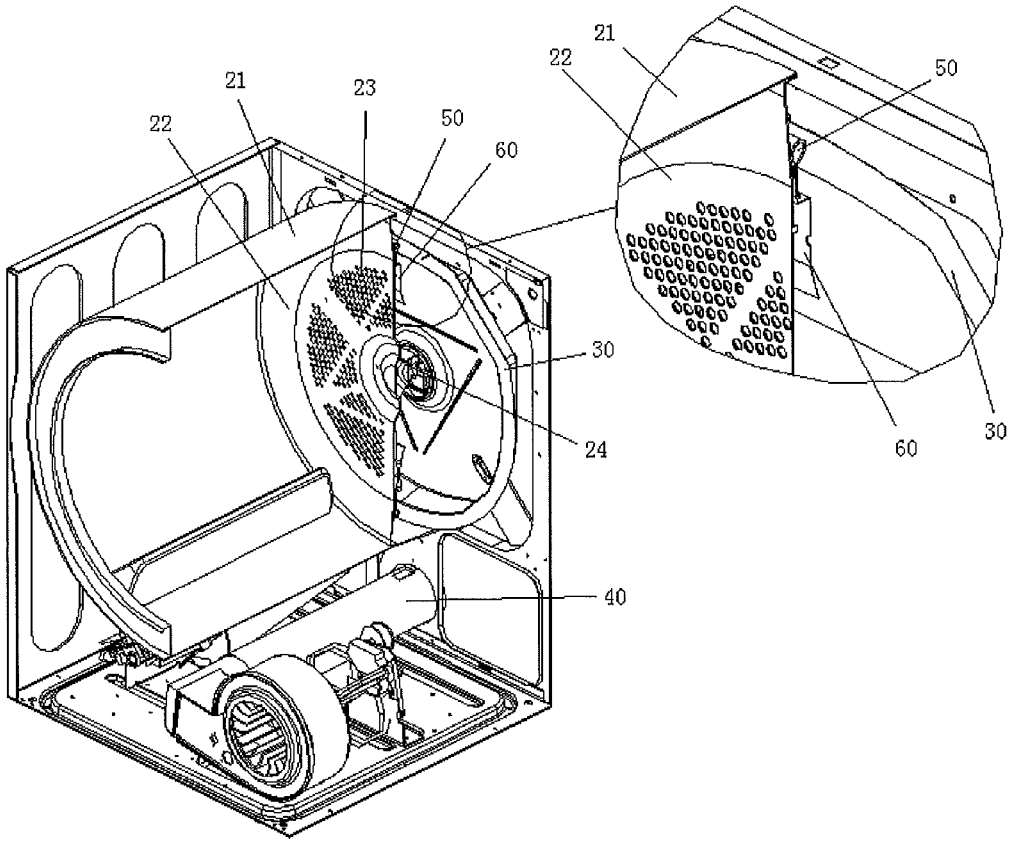
FIG. 5 is the disassembly elevational view of the seal unit of gas dryer.
Figure 6:
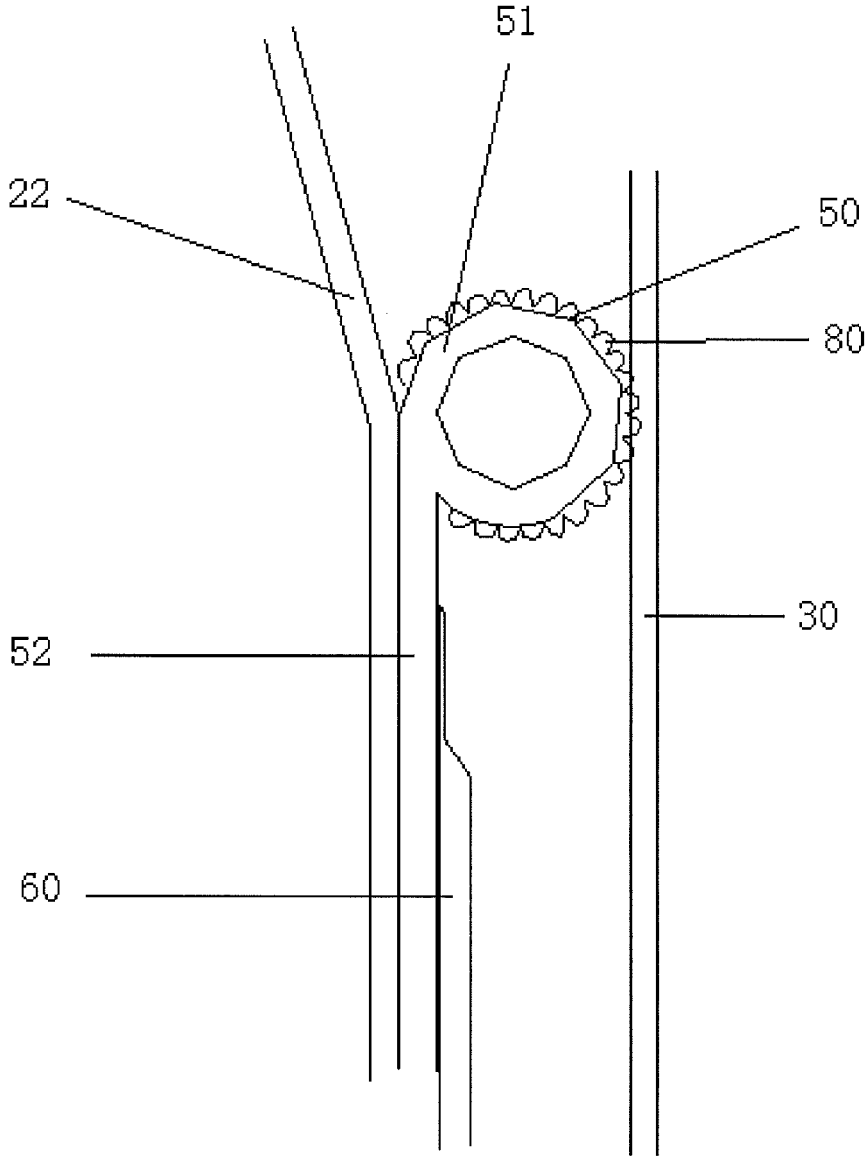
FIG. 6 is the sectional view of the seal loop of embodiment 1 of the invention.
Figure 7:
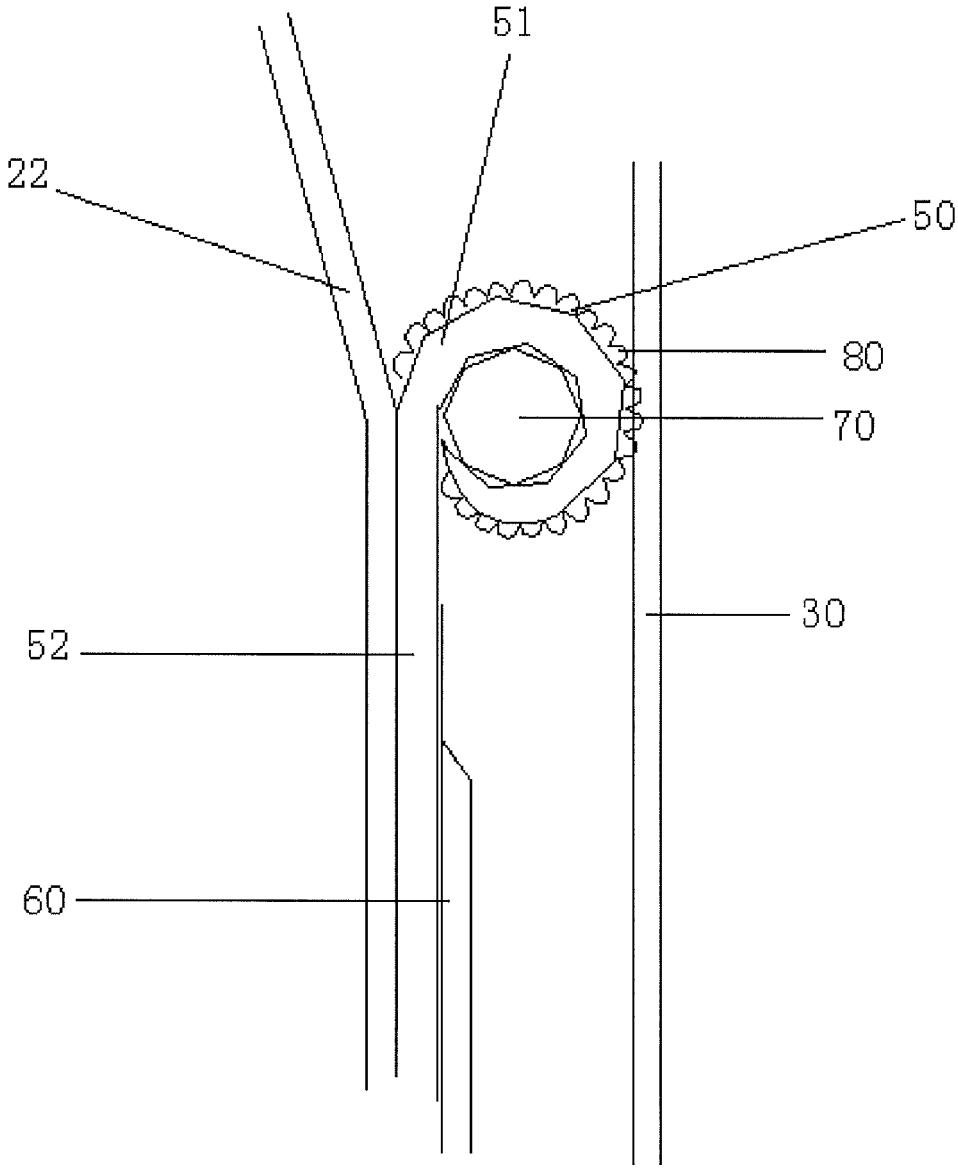
FIG. 7 is the sectional view of the seal loop of embodiment 2 of the invention.

This invention provides a seal unit of gas dryer, shown in FIG. 2-FIG. 7, chamber body 21 is integrated with chamber rear wall 22, an amount of hot-air holes 23 are set on the chamber rear wall 22 in which center there set an supporting shaft 24; a concavity part is formed in the center of the heating disk 30 shaped as a round disc, a bearing inside the concavity part is rotatably assembled with supporting shaft 24; heating disk 30 is fixed with heating-air duct 40, hot-air is blown into heating disk 30 by hot-air duct 40, further into the chamber 20 through hot-air holes 24 to dry clothes in chamber 20.

EMBODIMENT 1

Shown in FIG. 2-FIG. 6

To prevent hot-air from leaking from the gap between the rotatable chamber rear wall 22 and still heating disk 30, seal loop 50 shaped as a ring is mounted between the chamber rear wall 22 and heating disk 30. To overcome the objections of the present felt, seal loop 50 provided by this present invention is divided into inner fix part 52 and outer seal part 51, said inner fix part 52 has a shape of flat-sheet ring, said outer seal part 51 has a shape of closed ring and its section is also a closed ring formed by the crimp of one end of the flat-sheet ring of inner fix part 51 to the other end. Flexible porous materials is filled in the section of said outer seal part 51 on which surface salients are mounted. The ratio of the diameter of the section ring of the outer seal part 51 to the difference value between the inner and outer radius of said flat-sheet ring is 0.5-1.2. Seal loop 50 is made of wool felt.

Seal loop 50 is fixed on the chamber rear wall 22 either by thermosol or by a fixed loop 60. Inner fix part 52 of seal loop 50 is fixed on the chamber rear wall 22 by fixed loop 60. Fixed loop 60 compresses on the outer seal part 51 with ring section to seal with chamber rear wall 22. Said outer seal part 51 of seal loop 50 have better elasticity and even more elastic module than present felt, because of its ring section, to make up the deficient sealing performance caused by the axial sloshing in the chamber 20 rotating process, and prevent hot-air from leaking, decrease the power consumption and fast the drying speed.

On said fixed loop 60 there set fixed holes 61, and corresponding fixed blocks 26 with at least one threaded hole 25 are respectively set on the chamber rear wall 22, fixed loop 60 is mounted on the chamber rear wall 22 by the fixed holes 61 and threaded holes 25 on the fixed blocks 26, it's preferred that the amount of fixed holes 61 and corresponding fixed blocks 26 with threaded holes 25 on the chamber rear wall 22 are respectively 3, and the angle between every two of them is 120 degrees. To firmly fix the seal loop 50 on the chamber rear wall and prevent from loosening and displacement of seal loop 50, fixed loop 60 is enclosed with fastening teeth 81 on the outer end of the circumference of the fixed loop 60 which is fixed on the chamber rear wall 22 by said fastening teeth.

EMBODIMENT 2

Shown in FIG. 2-FIG. 5 & FIG. 7

Seal loop 50 is assembled between chamber rear wall 22 and heating disk 30, said seal loop 50 is comprised of inner fix part 52 and outer seal part 51, outer seal part 51 has a shape of closed ring and its section is a open ring formed by the crimp of one end of the flat-sheet inner fix part 52 to the other end, a cirque 70 made of elastic material and with the same shape of the section of open ring is filled in this open ring, an amount of salients 80 are set on the outer surface of the outer seal part 51. Seal loop 50 is made of wool felt.

As a result of The ring section of outer seal part 51 of seal loop 50 along with filling cirque 70 made of elastic material filled inside, the seal unit has better elasticity, sealing performance, and efficiently compensates the gap between rotatable chamber 20 and still heating disk 30, as well as prevents hot-air from leaking, decreases energy consumption, raises drying speed. The elastic material is easily assembled because of the structure of open ring of outer seal part 51. The salients on the surface of outer seal part 51 would improve the friction and sealing performance.

Seal loop 50 is fixed on the chamber rear wall 22 by either thermosol or a fixed loop 60. Inner fixed part 52 of seal loop 50 is fixed on the chamber rear wall 22 by fixed loop 60. On said fixed loop 60 there set fixed holes 61, and corresponding fixed blocks 26 with at least one threaded hole 25 are respectively set on the chamber rear wall 22, fixed loop 60 is mounted on the chamber rear wall 22 by the fixed holes 61 and threaded holes 25 on the fixed blocks 26, it's preferred that the amount of fixed holes 61 and corresponding fixed blocks 26 with threaded holes 25 on the chamber rear wall 22 are respectively 3, and the angle between every two of them is 120 degrees. To firmly fix the seal loop 50 on the chamber rear wall and prevent from loosening and displacement of seal loop 50, fixed loop 60 is enclosed with fastening teeth 81 on the outer end of the circumference of the fixed loop 60 which is fixed on the chamber rear wall 22 by said fastening teeth.

The protection scope of the present invention isn't restricted by the record of the specification. All meet the joint of technique features in claims are protected by this invention

The invention claimed is:

1. A gas dryer, comprising:

a chamber and a seal unit being assembled on a rear wall of the chamber, with an end of a heating disk compressing said seal unit, wherein said seal unit comprises a seal loop shaped as a ring, said seal loop comprising an inner fixed part with a shape of a flat-sheet ring which is fixed on the chamber rear wall, and an outer seal part for sealing the chamber rear wall with the heating disk, said outer seal part being joined with one end of the flat-sheet ring of the inner fixed part, and the heating disk compressing on the outer seal part which has a ring section, wherein the seal unit further comprises a fixed loop assembled between the chamber rear wall and the heating disk, said fixed loop comprising fastening teeth for fixing the seal loop and fixed structure for assembling the fixed loop on the chamber rear wall, and wherein the fastening teeth are set on an outer end of a circumference of the fixed loop and said fixed structure is formed by fixed holes set on the fixed loop, and corresponding fixed blocks with at least one threaded hole are respectively set on the chamber rear wall, and the inner fixed part is fixed on the chamber rear wall by the fastening teeth.

2. The gas dryer of claim 1, wherein said outer seal part has a shape of a closed ring and its section is also a closed ring formed by a crimp of one end of the flat-sheet ring of the inner fixed part to an other end of the flat sheet ring of the inner fixed part.

3. The gas dryer of claim 1, wherein flexible porous materials are filled in the section of said outer seal part on which surface salients are mounted.

4. The gas dryer of claim 1, wherein, the ratio of a diameter of the section ring of the outer seal part to a difference value between the inner and outer radius of said flat-sheet ring is 0.5-1.2.

5. The gas dryer of claim 1, wherein said outer seal part has a shape of a closed ring and its section is an open ring formed by the crimp of one end of the flat-sheet ring of the inner fixed part to an other end of the flat sheet ring of the inner fixed part, a cirque made of elastic material which has the same shape of the section of said open ring being filled in the open ring, a plurality of salients being set on a surface of the outer seal part.

6. The gas dryer of claim 1, wherein said seal loop is fixed on the chamber rear wall by thermosol.

7. The gas dryer of claim 1, wherein said seal loop is made of wool felt.

* * * * *